US007334569B2

(12) United States Patent
Kobayashi

(10) Patent No.: US 7,334,569 B2
(45) Date of Patent: Feb. 26, 2008

(54) CONTROL APPARATUS FOR INTERNAL COMBUSTION ENGINE

(75) Inventor: Daisuke Kobayashi, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/368,658

(22) Filed: Mar. 7, 2006

(65) Prior Publication Data

US 2006/0207566 A1 Sep. 21, 2006

(30) Foreign Application Priority Data

Mar. 18, 2005 (JP) ..... 2005-078287

(51) Int. Cl.
*F02B 7/00* (2006.01)
*F02B 7/04* (2006.01)

(52) U.S. Cl. ..... 123/431; 123/299

(58) Field of Classification Search ..... 123/431, 123/672, 696, 295, 299
See application file for complete search history.

(56) References Cited

U.S. PATENT DOCUMENTS 5,063,886 A 11/1991 Kanamaru et al.
6,314,940 B1 11/2001 Frey et al.
6,453,229 B1 * 9/2002 Ohkuma et al. ..... 701/109
6,786,196 B2 * 9/2004 Nakano et al. ..... 123/344
2001/0025635 A1 * 10/2001 Takahashi et al. ..... 123/679
2001/0029936 A1 * 10/2001 Takahashi et al. ..... 123/696
2003/0065438 A1 * 4/2003 Katoh ..... 701/104
2004/0144362 A1 7/2004 Nakano et al.
2004/0149255 A1 8/2004 Zur Loye et al.
2005/0066939 A1 * 3/2005 Shimada et al. ..... 123/431
2005/0161032 A1 * 7/2005 Nakagawa et al. ..... 123/673
2006/0011165 A1 1/2006 Frey et al.

FOREIGN PATENT DOCUMENTS

EP 0 947 684 A2 10/1999
EP 1 039 112 A2 9/2000
EP 1 260 695 A2 11/2002
EP 1 439 292 A2 7/2004
JP A 2-153241 6/1990
JP A 11-351011 12/1999
JP A 2003-13785 1/2003
WO WO 2004/074666 A1 9/2004

* cited by examiner

*Primary Examiner*—Mahmoud Gimie
(74) *Attorney, Agent, or Firm*—Oliff & Berridge, PLC

(57) ABSTRACT

An air-fuel ratio feedback system is configured to calculate the deviation between a target air-fuel ratio and an air-fuel ratio sensor value, multiplying a proportional gain by the calculated deviation to obtain a feedback correction value, and add the calculated feedback correction value to the in-cylinder injection quantity of an in-cylinder injector that is obtained by multiplying the fuel injection ratio of the in-cylinder injector by the basic fuel injection quantity. The calculated feedback correction value is not added to the port injection quantity of the intake manifold cylinder.

20 Claims, 7 Drawing Sheets

CONTROL APPARATUS FOR INTERNAL COMBUSTION ENGINE

This nonprovisional application is based on Japanese Patent Application No. 2005-078287 filed with the Japan Patent Office on Mar. 18, 2005, the entire contents of which are hereby incorporated by reference.

BACKGROUND OF THE INVENTION

1. Field of the Invention

The present invention relates to a control apparatus for an internal combustion engine including a first fuel injection mechanism (in-cylinder injector) injecting fuel into a cylinder and a second fuel injection mechanism (intake manifold injector) injecting fuel towards an intake manifold or an intake port, and particularly to a control apparatus for feedback control of the air-fuel ratio of the exhaust system prior to the catalyst to the stoichiometric air-fuel ratio.

2. Description of the Background Art

An internal combustion engine is well-known, including an intake manifold injector for injecting fuel into the intake manifold of the engine and an in-cylinder injector for injecting fuel into the engine combustion chamber, wherein fuel injection from the intake manifold injector is inhibited when the engine load is lower than a predetermined set load, and fuel injection from the intake manifold injector is conducted when the engine load is higher than the set load.

In general, a catalytic converter for purifying noxious components in the exhaust gas is provided at the exhaust system of an internal combustion engine. A three-way catalytic converter is generally used as such a catalytic converter. The three-way catalytic converter oxidizes carbon monoxide (CO) and unburned hydrocarbon (HC) and reduces nitride oxide (NOx) that are the three noxious components in the exhaust gas to turn them into innoxious carbon dioxide ($CO_2$), water vapor ($H_2O$), and nitrogen ($N_2$).

The purifying performance of the three-way catalytic converter depends upon the air-fuel ratio of the air-fuel mixture developed in the combustion chamber. The three-way catalytic converter functions most effectively when the air fuel ratio is in the vicinity of the stoichiometric air-fuel ratio. This is because all these three noxious components set forth above cannot be purified favorably since oxidation is active whereas reduction is inactive when the air-fuel ratio is lean and the amount of oxygen in the exhaust gas is high, and the reduction is active whereas oxidization is inactive when the air-fuel ratio is rich and the amount of oxygen in the exhaust gas is low. Therefore, an internal combustion engine including a three-way catalytic converter has an output linear type oxygen sensor provided at the exhaust manifold. Feedback control is executed such that the air-fuel ratio of the air-fuel mixture in the combustion engine corresponds to the stoichiometric air-fuel ratio (the ideal air-fuel mixture ratio; hereinafter also termed stoichiometric ratio) based on the oxygen concentration measured by the oxygen sensor.

Japanese Patent Laying-Open No. 11-351011 discloses a fuel injection control apparatus for an internal combustion engine that includes an auxiliary fuel injection valve that allows fuel to be injected into the intake manifold in addition to a main fuel injection valve for directly injecting fuel into the combustion chamber. The auxiliary fuel injection valve is operated under a predetermined operation condition. In the case where the main fuel injection valve and the auxiliary fuel injection valve partake in fuel injection into the internal combustion engine, control is effected to prevent erroneous learning by a temporary error in air-fuel ratio at the time of switching between operation and non-operation of the auxiliary fuel injection valve. This control apparatus corresponds to a fuel injection control apparatus for a direct-injection spark plug type internal combustion engine including a main fuel injection valve to inject fuel directly into the combustion chamber. This control apparatus includes basic fuel injection quantity calculation means for calculating the basic fuel injection quantity based on the operation condition of the engine, air-fuel ratio feedback correction coefficient setting means for setting by increasing/decreasing the air-fuel ratio feedback correction coefficient according to whether the air-fuel ratio detected by the air-fuel ratio sensor is rich or lean at a predetermined air-fuel ratio feedback control condition, a rewritable learning correction coefficient storage means for storing a learning correction coefficient, fuel injection quantity calculation means for calculating the fuel injection quantity based on the basic fuel injection quantity, the air-fuel ratio feedback correction coefficient, and the learning correction coefficient, and learning means for updating the learning correction coefficient in a direction approximating the reference value based on the air-fuel ratio feedback correction coefficient by learning at a predetermined learning condition. This control apparatus further includes switching control means for operating the auxiliary fuel injection valve at a predetermined operation condition such that the main fuel injection valve and the auxiliary fuel injection valve partake in fuel injection into the internal combustion engine. Learning inhibition means is provided to inhibit learning based on the learning means for a predetermined period at the time of switching between an operating and non-operating state of the auxiliary fuel injection valve.

The fuel injection control apparatus for an internal combustion engine set forth above is advantageous in that the learning accuracy is improved since erroneous learning of a temporary error in air-fuel ratio at the time of switching between an operating and non-operating state of the auxiliary fuel injection valve is eliminated.

Although the convergence towards a target value is accelerated as the gain of feedback control becomes higher, there is the possibility of oscillation when the gain is too high. This gain depends upon the inefficient time and/or delay in response of the control system. The gain can be set higher as the inefficient time and/or delay in response becomes smaller to allow increase in response to the target value.

In the apparatus disclosed in the aforementioned Japanese Patent Laying-Open No. 11-351011, the required injection quantity is calculated based on the basic fuel injection quantity and the correction by feedback control. The required injection quantity is multiplied by the fuel injection ratio of the fuel injection valve (in-cylinder injector) to the auxiliary fuel injection valve (intake manifold injector) to calculate the fuel injection quantity of the in-cylinder injector and the fuel injection quantity of the intake manifold injector. The fuel injected from the intake manifold injector will adhere to the inner wall of the intake manifold, causing delay in response. Since a high gain cannot be set, the gain used in calculating the value of correction by feedback control had to be set at a low level. It was therefore difficult to increase the response to the target value.

The tendency of causing delay in response due to the wall adherence of fuel injected from the intake manifold injector becomes more significant as the intake manifold is under a cold state. Therefore, the gain must be modified depending upon the temperature. This means that, even if the amount of fuel injected from the intake manifold injector is increased to achieve a rich state from the lean state, a high gain cannot be set since the delay is serious due to the effect of adherence at the wall when the temperature is low. Thus, favorable response could not be realized.

SUMMARY OF THE INVENTION

An object of the present invention is to provide a control apparatus for an internal combustion engine that includes a first fuel injection mechanism for injecting fuel towards a cylinder and a second fuel injection mechanism for injecting fuel towards the intake manifold or an intake port, allowing air-fuel ratio feedback control of favorable response.

According to an aspect of the present invention, a control apparatus controls an internal combustion engine that includes a first fuel injection mechanism injecting fuel into a cylinder and a second fuel injection mechanism injecting fuel into an intake manifold. The control apparatus includes an injection control unit controlling the first and second fuel injection mechanisms such that the first fuel injection mechanism and the second fuel injection mechanism partake in fuel injection based on a condition required of the internal combustion engine, a sensing unit provided at the exhaust system of the internal combustion engine for sensing the air-fuel ratio of the exhaust, and a control unit for executing feedback control such that the air-fuel ratio attains the target air-fuel ratio based on the sensed air-fuel ratio. The control unit executes feedback control only on the quantity of fuel injection by the first fuel injection mechanism.

In the execution of feedback control involving a proportional action corresponding to multiplying the difference between a target air-fuel ratio and sensed air-fuel ratio by a proportional gain, only the quantity of fuel injected by the first fuel injection mechanism that injects fuel into a cylinder (for example, in-cylinder injector) is taken as the control input of the feedback system in the proportional action. Although the second fuel injection mechanism injecting fuel into an intake manifold (for example, an intake manifold injector) causes delay time due to the injected fuel adhering to the wall of the intake manifold and the distance up to the combustion chamber, the in-cylinder injector is absent of such delay time, allowing a high gain to be set in the proportional action of feedback control. Accordingly, the response in feedback control can be improved. Thus, a control apparatus for an internal combustion engine including a first fuel injection mechanism injecting fuel towards a cylinder and a second fuel injection mechanism injecting fuel towards the intake manifold or intake port, allowing air-fuel ratio feedback control of favorable response can be provided.

According to another aspect of the present invention, a control apparatus controls an internal combustion engine that includes a first fuel injection mechanism injecting fuel into a cylinder and a second fuel injection mechanism injecting fuel into an intake manifold. The control apparatus includes an injection control unit controlling the first and second fuel injection mechanisms such that the first and second fuel injection mechanisms partake in fuel injection based on a condition required of the internal combustion engine, a sensing unit provided at the exhaust system of the internal combustion engine for sensing the air-fuel ratio of the exhaust, and a control unit executing PID feedback control such that the air-fuel ratio attains the target air-fuel ratio based on the sensed air-fuel ratio. The control unit executes feedback control such that the proportional action and derivative action are reflected in the fuel injection quantity of the first fuel injection mechanism, and the integral action is reflected in the fuel injection quantity of the second fuel injection mechanism.

In addition to the proportional action in the feedback control system of the present invention, an integral action to eliminate the steady state deviation or a derivative action to compensate for the integral action to improve control stability may be added. Since the fuel injection ratio between the in-cylinder injector and the intake manifold injector is set based on the operation state of the internal combustion engine in addition to such air-fuel ratio feedback control, the fuel injection ratio will deviate from the injection ratio calculated from the operation state of the internal combustion engine if only the quantity of fuel injected from the intake manifold injector is employed for the control input in the air-fuel ratio feedback control. In view of this issue, the control input of the feedback system in the integral action is reflected in the fuel injection quantity of the intake manifold injector, whereas the control input of the feedback system in the proportional action and derivative action is reflected in only the fuel injection quantity of the in-cylinder injector. Since the delay time caused by the fuel injected from the intake manifold injector adhering on the wall does not affect the integral action, a feedback control system of favorable response and of no steady state deviation can be realized while obviating significant deviation from the fuel injection ratio of the in-cylinder injector to the intake manifold injector that is calculated based on the operation state of the internal combustion engine. Thus, a control apparatus for an internal combustion engine including a first fuel injection mechanism injecting fuel towards a cylinder and a second fuel injection mechanism injecting fuel towards the intake manifold or intake port, allowing stable air-fuel ratio feedback control of favorable response and of no steady state deviation can be provided.

According to a further aspect of the present invention, a control apparatus controls an internal combustion engine that includes a first fuel injection mechanism injecting fuel into a cylinder and a second fuel injection mechanism injecting fuel into an intake manifold. The control apparatus includes an injection control unit controlling the first and second fuel injection mechanisms such that the first and second fuel injection mechanism partake in fuel injection based on a condition required of the internal combustion engine, a sensing unit provided at the exhaust system of the internal combustion engine for sensing the air-fuel ratio of the exhaust, and a control unit executing PI feedback control such that the air-fuel ratio attains the target air-fuel ratio based on the sensed air-fuel ratio. The control unit executes feedback control such that the proportional action is reflected in the fuel injection quantity of the first fuel injection mechanism and the integral action is reflected in the fuel injection quantity of the second fuel injection mechanism.

In addition to the proportional action in the feedback control system of the present invention, an integral action to eliminate steady state deviation may be added. Since the fuel injection ratio between the in-cylinder injector and the intake manifold injector is set based on the operation state of the internal combustion engine in addition to such air-fuel ratio feedback control, the fuel injection ratio will deviate from the injection ratio calculated from the operation state of the internal combustion engine if only the quantity of fuel injected from the intake manifold injector is employed for the control input in the air-fuel ratio feedback control. In view of the foregoing, the control input of the feedback system in the integral action is reflected in the fuel injection quantity of the intake manifold injector, whereas the control input of the feedback system in the proportional action is reflected in only the fuel injection quantity of the in-cylinder injector. Since the delay time caused by the fuel injected from the intake manifold injector adhering on the wall does not affect the integral action, a feedback control system of favorable response can be realized while obviating significant deviation from the fuel injection ratio of the in-cylinder injector to the intake manifold injector that is calculated based on the operation state of the internal combustion engine. Thus, a control apparatus for an internal combustion engine including a first fuel injection mechanism injecting fuel towards a cylinder and a second fuel injection mechanism injecting fuel towards the intake manifold or intake port, allowing air-fuel ratio feedback control of favorable response and of no steady state deviation can be provided.

Preferably, the control unit executes feedback control such that the correction value corresponding to the integral action is distributed between the fuel injection quantity of the first fuel injection mechanism and the fuel injection quantity of the second fuel injection mechanism based on the fuel injection ratio.

In accordance with the present invention, the proportional action (P parameter) and the derivative action (D parameter) become zero under a steady state. Therefore, the basic fuel injection ratio of target can be realized by distributing the correction value corresponding to the integral action (I parameter) depending upon the fuel injection ratio.

Further preferably, the first fuel injection mechanism is an in-cylinder injector, and the second,fuel injection mechanism is an intake manifold injector.

In accordance with the present invention, there can be provided a control apparatus for an internal combustion engine that includes an in-cylinder injector as the first fuel injection mechanism and an intake manifold injector as the second fuel injection mechanism, partaking in fuel injection, and allowing air-fuel ratio feedback control of favorable response.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
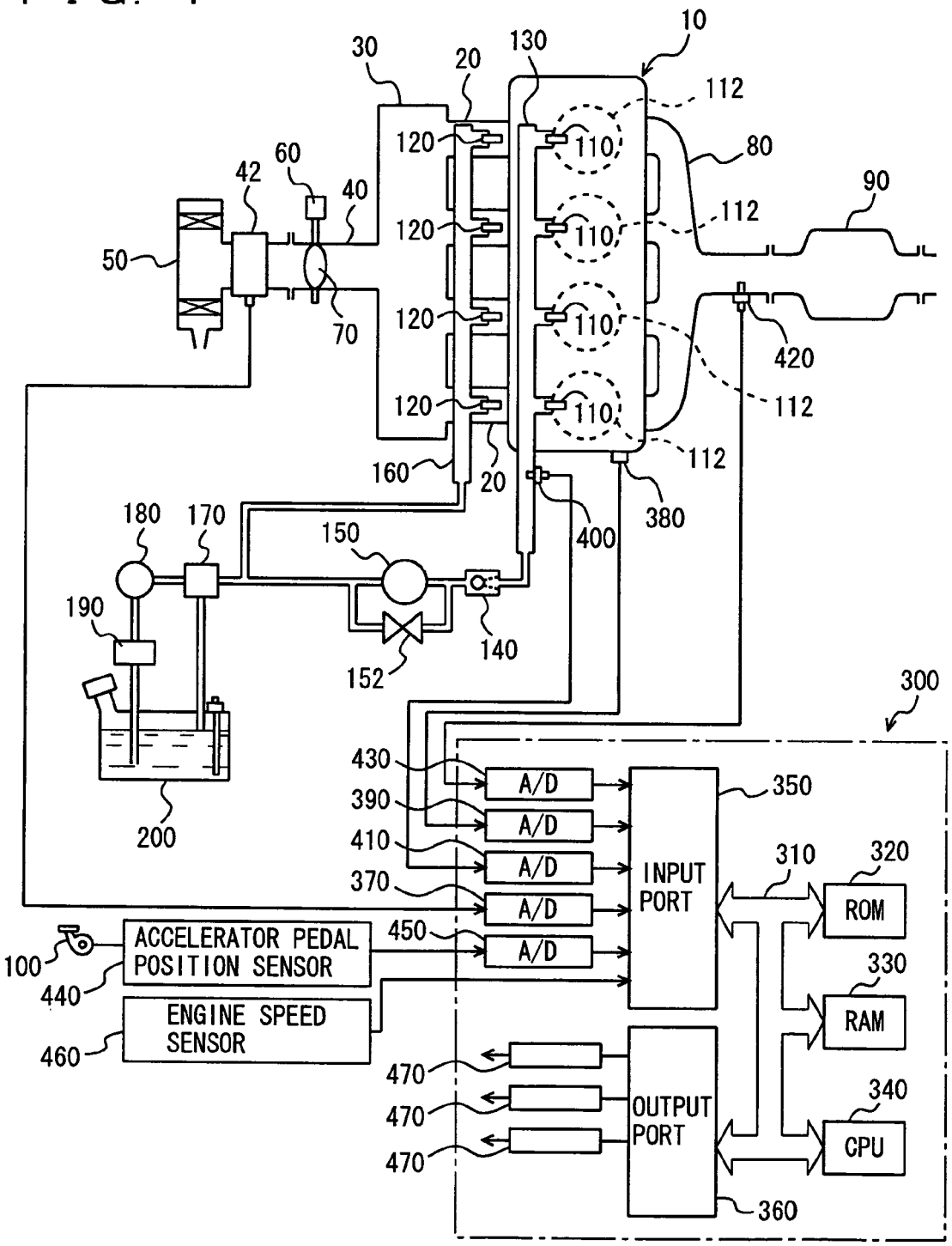
FIG. 1 is a schematic diagram showing a structure of an engine system under control of a control apparatus according to an embodiment of the present invention.

Embodiments of the present invention will be described hereinafter with reference to the drawings. The same components have the same reference characters allotted, and their designation and function are also identical. Therefore, detailed description thereof will not be repeated.

FIG. 1 is a schematic view of a structure of an engine system under control of an engine ECU (Electronic Control Unit) identified as a control apparatus for an internal combustion engine according to an embodiment of the present invention. Although an in-line 4-cylinder gasoline engine is indicated as the engine, the present invention is not limited to such an engine.

As shown in FIG. 1, the engine 10 includes four cylinders 112, each connected to a common surge tank 30 via a corresponding intake manifold 20. Surge tank 30 is connected via an intake duct 40 to an air cleaner 50. An airflow meter 42 is arranged in intake duct 40, and a throttle valve 70 driven by an electric motor 60 is also arranged in intake duct 40. Throttle valve 70 has its degree of opening controlled based on an output signal of an engine ECU 300, independently from an accelerator pedal 100. Each cylinder 112 is connected to a common exhaust manifold 80, which is connected to a three-way catalytic converter 90.

Each cylinder 112 is provided with an in-cylinder injector 110 for injecting fuel into the cylinder and an intake manifold injector 120 for injecting fuel into an intake port or/and an intake manifold. Injectors 110 and 120 are controlled based on output signals from engine ECU 300. Further, in-cylinder injector 110 of each cylinder is connected to a common fuel delivery pipe 130. Fuel delivery pipe 130 is connected to a high-pressure fuel pump 150 of an engine-driven type, via a check valve 140 that allows a flow in the direction toward fuel delivery pipe 130. Although an internal combustion engine having two injectors separately provided is explained in the present embodiment, the present invention is not restricted to such an internal combustion engine. For example, the internal combustion engine may have one injector that can effect both in-cylinder injection and intake manifold injection.

As shown in FIG. 1, the discharge side of high-pressure fuel pump 150 is connected via an electromagnetic spill valve 152 to the intake side of high-pressure fuel pump 150. As the degree of opening of electromagnetic spill valve 152 is smaller, the quantity of the fuel supplied from high-pressure fuel pump 150 into fuel delivery pipe 130 increases. When electromagnetic spill valve 152 is fully open, the fuel supply from high-pressure fuel pump 150 to fuel delivery pipe 130 is ceased. Electromagnetic spill valve 152 is controlled based on an output signal of engine ECU 300.

Each intake manifold injector 120 is connected to a common fuel delivery pipe 160 at the low pressure side. Fuel delivery pipe 160 and high-pressure fuel pump 150 are connected to an electromotor driven type low-pressure fuel pump 180 via a common fuel pressure regulator 170. Low-pressure fuel pump 180 is connected to fuel tank 200 via fuel filter 190. When the fuel pressure of fuel ejected from low-pressure fuel pump 180 becomes higher than a predetermined set fuel pressure, fuel pressure regulator 170 returns a portion of the fuel output from low-pressure fuel pump 180 to fuel tank 200. Accordingly, the fuel pressure supplied to intake manifold injector 120 and the fuel pressure supplied to high-pressure fuel pump 150 are prevented from becoming higher than the set fuel pressure.

Engine ECU 300 is based on a digital computer, and includes a ROM (Read Only Memory) 320, a RAM (Random Access Memory) 330, a CPU (Central Processing Unit) 340, an input port 350, and an output port 360 connected to each other via a bidirectional bus 310.

Air flow meter 42 generates an output voltage in proportion to the intake air. The output voltage from air flow meter 42 is applied to input port 350 via an A/D converter 370. A coolant temperature sensor 380 producing an output voltage in proportion to the engine coolant temperature is attached to engine 10. The output voltage from coolant temperature sensor 380 is applied to input port 350 via an A/D converter 390.

A fuel pressure sensor 400 producing an output voltage in proportion to the fuel pressure in high pressure delivery pipe 130 is attached to high pressure delivery pipe 130. The output voltage from fuel pressure sensor 400 is applied to input port 350 via an A/D converter 410. An air-fuel ratio sensor 420 producing an output voltage in proportion to the oxygen concentration in the exhaust gas is attached to exhaust manifold 80 upstream of 3-way catalytic converter 90. The output voltage from air-fuel ratio 420 is applied to input port 350 via an A/D converter 430.

Air-fuel ratio sensor 420 in the engine system of the present embodiment is a full-range air-fuel ratio sensor (linear air-fuel sensor) producing an output voltage in proportion to the air-fuel ratio of air-fuel mixture burned at engine 10. Air-fuel ratio sensor 420 may be an $O_2$ sensor that detects whether the air-fuel ratio of air-fuel mixture burned at engine 10 is rich or lean to the stoichiometric ratio in an on/off manner.

An accelerator pedal position sensor 440 producing an output voltage in proportion to the pedal position of an accelerator pedal 100 is attached to accelerator pedal 100. The output voltage from accelerator pedal position sensor 440 is applied to input port 350 via an A/D converter 450. A revolution speed sensor 460 generating an output pulse representing the engine speed is connected to input port 350. ROM 320 of engine ECU 300 stores the value of the fuel injection quantity set corresponding to an operation state, a correction value based on the engine coolant temperature, and the like that are mapped in advance based on the engine load factor and engine speed obtained through accelerator pedal position sensor 440 and revolution speed sensor 460 set forth above.

Engine ECU 300 calculates the deviation between the air-fuel ratio (hereinafter, also indicated as A/F) of the exhaust gas applied from air-fuel ratio sensor 420 and a target air-fuel ratio (in the vicinity of 14.5 identified as the stoichiometric ratio), and executes feedback control such that the deviation is eliminated.

Figure 2:
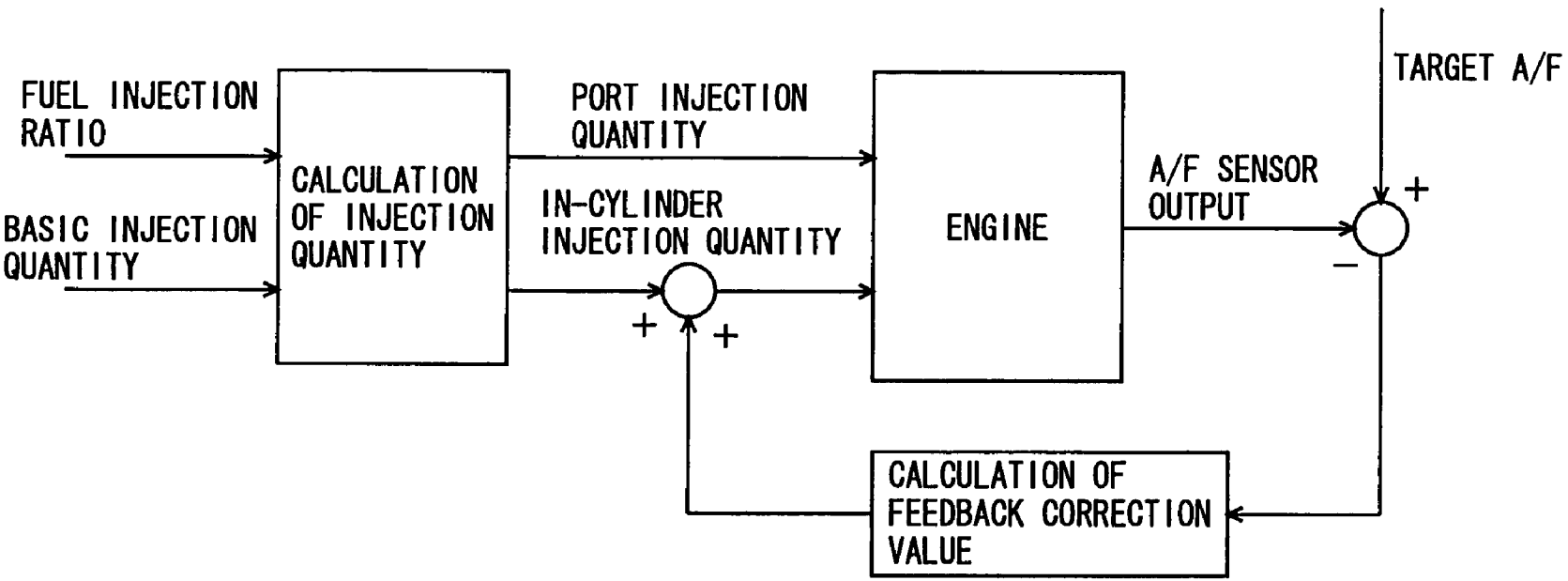
FIG. 2 is a control block diagram of air-fuel ratio feedback control (first control block diagram).

FIG. 2 is a control block diagram of the air-fuel ratio feedback control system incorporated in engine ECU 300. The feedback control system represented by such a block diagram is realized by a program executed by CPU 340.

Referring to FIG. 2, the feedback control system calculates a feedback correction value based on an A/F deviation obtained by subtracting the A/F sensor out from air-fuel ratio sensor 420 from the target air-fuel ratio. Specifically, the feedback correction value $\Delta Q = Kc \times |AF(TAG) - AF|$ is calculated where AF(TAG) is the target air-fuel ratio, AF is the air-fuel ratio that is output from the A/F sensor, and Kc is the proportional gain. The sign of $\Delta Q$ is set to + and − when the exhaust corresponds to the lean side and the rich side, respectively. This feedback correction value $\Delta Q$ is added to the quantity of fuel (in-cylinder injection quantity Qd) injected from in-cylinder injector 110.

The basic injection quantity Qall and the injection ratio (as used herein, this fuel injection ratio is expressed as "DI ratio r" as the ratio of the quantity of fuel injected from in-cylinder injector 110 to the total quantity of the fuel injected, i.e the quantity of fuel injected by in-cylinder injector 110 plus the quantity of fuel injected by intake manifold manifold 120) are calculated in accordance with predetermined maps based on the engine speed, load factor, and the like of engine 10 by engine ECU 300.

From basic injection quantity Qall and the fuel injection ratio (DI ratio r), in-cylinder injection quantity Qd that is the quantity of fuel injected by in-cylinder injector 110 and fuel injection quantity Qp that is the quantity of fuel injected by intake manifold injector 120 are calculated. Specifically, in-cylinder injection quantity $Qd = Qall \times r$, and port injection quantity $Qp = Qall \times (1 - r)$ are calculated. In the calculation, it is assumed that the correction fuel quantity such as correction of the amount adhering to the wall of intake manifold injector 120, correction of purge execution and the like, internal EGR (Exhaust Gas Recirculation) correction, and PCV correction are not taken into account.

Since feedback correction value $\Delta Q$ is reflected (added) to only in-cylinder injection quantity Qd, the eventual fuel injection quantity is:

in-fuel injection quantity $Qd = Qall \times r + \Delta Q = Qall \times r + Kc \times |AF(TAG) - AF|$ and port injection quantity $Qp = Qall \times (1 - r)$ The feedback correction amount $\Delta Q$ based on a proportional action is not reflected in in-cylinder injection quantity Qp that is the quantity of fuel injected by intake manifold injector 120.

Feedback correction value $\Delta Q$ is not reflected in port injection quantity Qp because the response cannot be improved since the fuel injected from intake manifold injector 120:

1) adheres to the wall of the intake manifold;

2) is injected during the intake stroke, followed by a compression stroke, a combustion and expansion stroke, and an exhaust stroke to be output as exhaust gas; and 3) is delayed in arriving at air-fuel ratio sensor 420 subsequent to output of exhaust gas;

causing delay time, and disallowing a high proportional gain Kc to be set in the proportional action of the feedback system.

It is not necessary to take into account the response delay factors such as adherence to the wall set forth above in association with fuel injected from in-cylinder injector 110. Thus, a high proportional gain Kc can be set since feedback correction value $\Delta Q$ is not reflected in the fuel injection quantity of intake manifold injector 120 whereas feedback correction value $\Delta Q$ is reflected in the fuel injection quantity of in-cylinder injector 110. Thus, the response can be rendered favorable.

Figure 3:
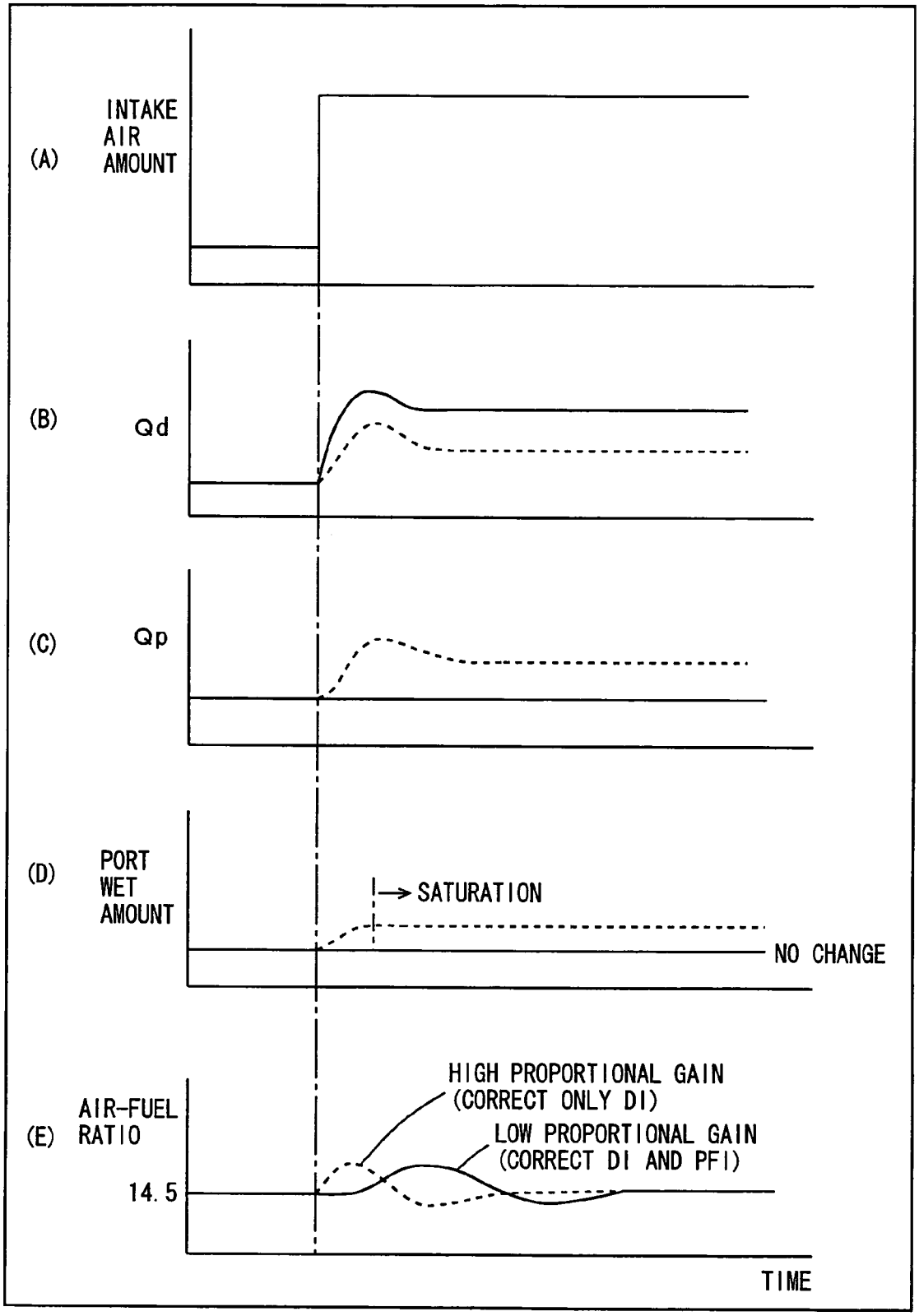
FIG. 3 is a timing chart representing change in each state when the amount of intake air is varied in a stepped manner.

FIG. 3 corresponds to the change the in-cylinder injection quantity Qd, the port injection quantity Qp, the port wet amount, and the air-fuel ratio over time when the intake air amount is increased in a stepped manner so that the exhaust gas is rendered lean. Here, it is assumed that the operation state of the engine has not changed except for the change in the intake air amount in a stepped manner, and the DI ratio r and basic injection quantity Qall have not changed. It is assumed that DI ratio r is 0.5.

In (B)-(E) of FIG. 3, the solid line corresponds to the case where the feedback correction value ΔQ based on a proportional action is reflected in only in-cylinder injection quantity Qd identified as the quantity of fuel injected from in-cylinder injector 110 and a high proportional gain Kc is set, whereas the dotted line corresponds to the case where feedback correction value ΔQ based on a proportional action is reflected in in-cylinder injection quantity Qd and port injection quantity Qp identified as the quantity of fuel injected by in-cylinder injector 110 and intake manifold injector 120, respectively, and a low proportional gain Kc is set.

<Feedback Correction on Only In-Cylinder Injection Quantity Qd, as Indicated by Solid Line>

By increasing the amount of intake air in a stepped manner as shown in FIG. 3 (A), air-fuel ratio AF sensed by air-fuel ratio sensor 420 becomes higher (rendered lean), and ΔQ is calculated as Kc(1)×|AF(TAG)−AF|. Since it is assumed that basic injection quantity Qall and DI ratio r do not change, in-cylinder injection quantity Qd is increased by just ΔQ, as indicated by the solid line in FIG. 3(B), by feedback control.

This increase ΔQ in in-cylinder injection quantity Qd will not cause increase in the port wet amount (the port injection quantity Qp of injection from intake manifold injector 120 does not change, as indicated by the solid line in FIG. 3(C), so that the port wet amount does not change, as indicated by the solid line in FIG. 3(D)). The event of the exhaust gas rendered rich by this increase in in-cylinder injection quantity Qd is exhibited with no delay time, and a high proportional gain Kc(1) is set. Therefore, the air-fuel ratio is promptly restored to the stoichiometric air-fuel ratio, as shown in FIG. 3 (E).

<Feedback Correction on In-Cylinder Injection Quantity Qd and Port Injection Quantity Qp, as Indicated by Dotted Line>

By increasing the amount of intake air in a stepped manner as shown in FIG. 3 (A), the air-fuel ratio AF sensed by air-fuel ratio sensor 420 becomes higher (rendered lean), and ΔQ is calculated as Kc(2)×|AF(TAG)−AF|. Here, Kc(1) >Kc(2) is established. Since it is assumed that basic injection quantity Qall and DI ratio r (=0.5) do not change, in-cylinder injection quantity Qd is increased by just ΔQ/2, as indicated by the dotted line in FIG. 3(B), and port injection quantity Qp is increased by just ΔQ/2, as indicated by the dotted line in FIG. 3(C), by feedback control.

Even if port injection quantity Qp of intake manifold injector 120 is increased by ΔQ/2, as indicated by the dotted line in FIG. 3(C), the increased fuel will adhere to the wall of the intake manifold until the port wet amount attains saturation, such that only ΔQ/2 is introduced into the combustion chamber after saturation, as indicated by the dotted line in FIG. 3(D). Therefore, a rich state of the exhaust gas is deferred in response to the increase in in-cylinder injection quantity Qp, and a low proportional gain Kc(2) is set. Thus, the air-fuel ratio is not promptly returned to the stoichiometric ratio, as shown in FIG. 3(E). In other words, the response is not favorable.

The control apparatus implemented by the engine ECU according to an embodiment of the present invention reflects the feedback correction value calculated by a proportional action in only the fuel injection quantity of the in-cylinder injector, and not in the intake manifold injector in a feedback control system involving a proportional action having the proportional gain multiplied by the difference between the target air-fuel ratio and the sensed air-fuel ratio. Accordingly, the event of preventing a high gain of the proportional action from being set in the feedback control due to the delay time in the intake manifold injector that injects fuel into the intake manifold can be obviated. Accordingly, the response in feedback control can be improved.

Figure 4:
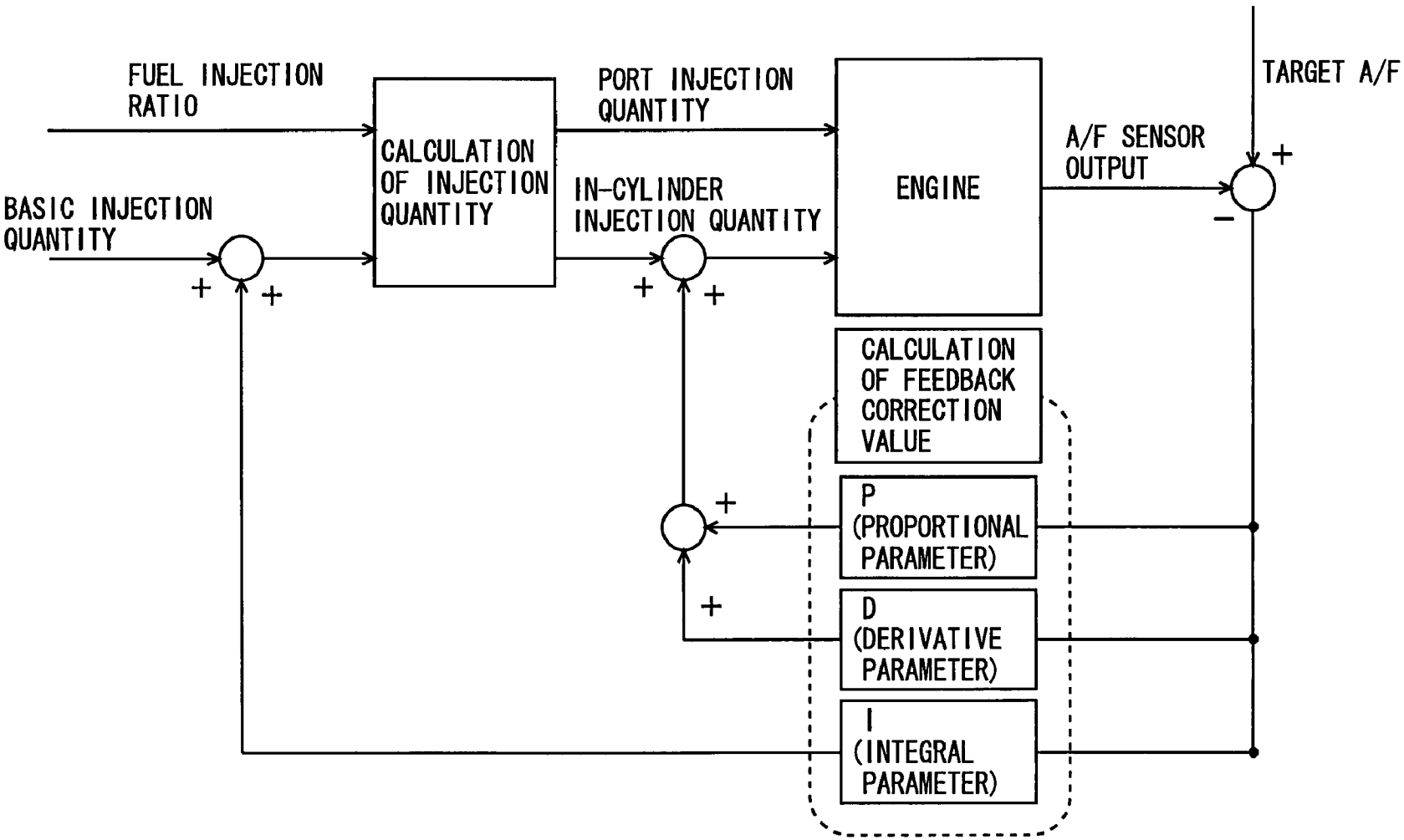
FIG. 4 is a control block diagram of an air-fuel ratio feedback control (second control block diagram).
Figure 5:
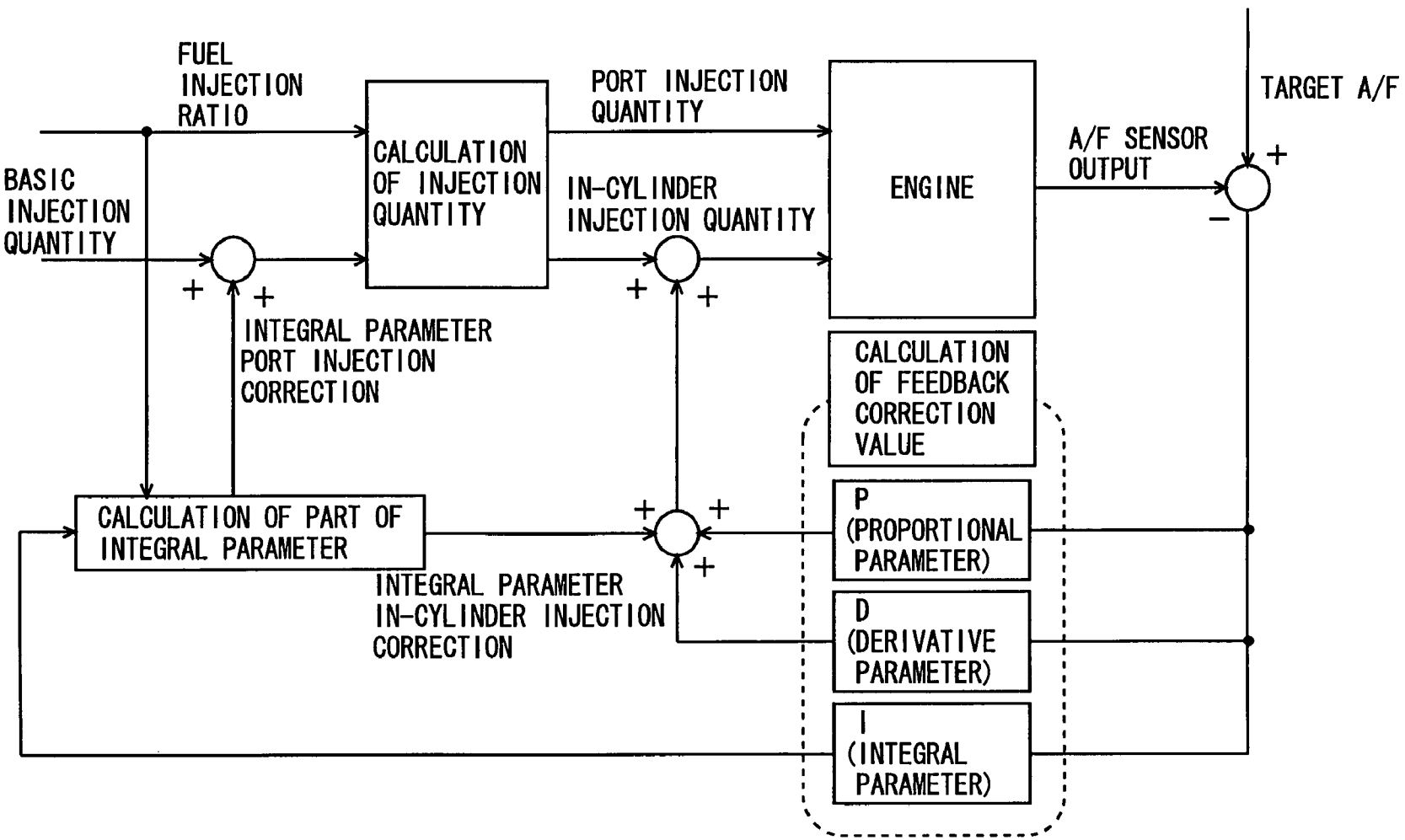
FIG. 5 is a control block diagram of an air-fuel ratio feedback control (third control block diagram).

Further, the feedback system shown in FIG. 4 is advantageous in eliminating the steady state deviation and ensuring stable control.

The feedback control system of FIG. 4 is referred to as PID control. The operation of the adjusting unit that calculates the feedback correction value includes, not only a proportional (P) action (P parameter), but also an integral (I) action (I parameter) corresponding to an action of eliminating steady state deviation, and a derivative (D) action (D parameter) obviating unstable control due to introduction of an integral action.

As shown in FIG. 4, only the integral action (I parameter) in the actions set forth above is reflected in basic injection quantity Qall. Since port injection quantity Qp corresponding to the fuel injection quantity by intake manifold injector 120 is calculated from basic injection quantity Qall, only the integral action will be reflected in the fuel injection quantity of intake manifold injector 120. As shown in FIG. 4, the proportional action (P parameter) and derivative action (D parameter) are reflected in only in-cylinder injection quantity Qd that is the quantity of fuel injected from in-cylinder injector 110.

Accordingly, steady state deviation can be eliminated by the integral action, and unstable control can be eliminated by incorporating an integral action. Thus, a feedback control system of favorable response and favorable stability with no steady state deviation can be realized.

Although the fuel injection quantity will be increased in the case (lean) where the target air-fuel ratio (AF (TAG)) is higher than the air-fuel ratio AF sensed by air-fuel ratio sensor 420 since an integral action is reflected in basic injection quantity Qall, not only in-cylinder injection quantity Qd but also port injection quantity Qp is increased since the integral action is reflected in basic injection quantity Qall. At this stage, if the integral action is not reflected in basic injection quantity Qall, only in-cylinder injection quantity Qd, and not port injection quantity Qp, will be increased, such that the injection ratio will be deviated from the DI ratio r calculated based on the operation state (engine speed, low factor) of engine 10. However, since port injection quantity Qp is increased by reflecting the integral action in basic injection quantity Qall, the deviation in DI ratio r can be reduced.

It is to be noted that the proportional action (P parameter) and derivative action (D parameter) become 0 at a steady state. Therefore, it is preferable to distribute the integral action (I parameter) in accordance with the fuel injection ratio to realize the target basic DI ratio r.

In the control apparatus executed by an engine ECU according to an embodiment off the present invention, the feedback correction value calculated by a proportional action and derivative action is reflected in only the fuel injection quantity of the in-cylinder injector, and the feedback correction value calculated by an integral action is reflected in the fuel injection quantity of the intake manifold injector in accordance with the feedback control system that executes a proportional action, an integral action, and a derivative action on the difference between the target air-fuel ratio and the sensed air-fuel ratio. Accordingly, in addition to avoiding the event of not being able to set a high gain for the proportional action in feedback control, steady state deviation can be eliminated by the integral action, and stability in the control system by the derivative action can be ensured. There is also the advantage of obviating great deviation in the DI ratio r. Accordingly, the response in feedback control can be improved while avoiding great deviation in the DI ratio r, eliminating steady state deviation, and improving stability.

Depending upon the characteristics of the control system, a PI control system involving a proportional (P) action (P parameter) and an integral (I) action (I parameter) may be configured based on a structure absent of the derivative (D) action (D parameter) from the control block diagram of FIG. 3.

<Engine (1) to which Present Control Apparatus can be Suitably Applied>

An engine (1) to which the control apparatus of the present embodiment is suitably adapted will be described hereinafter.

Figure 6:
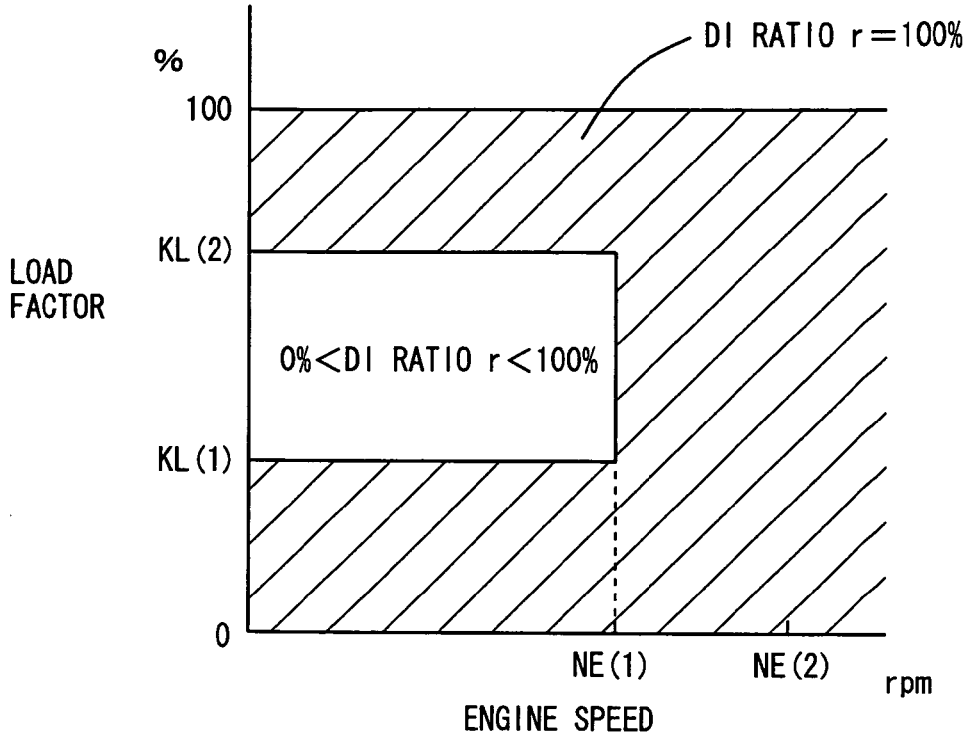
FIG. 6 represents a DI ratio map corresponding to a warm state of an engine to which the control apparatus of an embodiment of the present invention is suitably adapted (first DI ratio map).
Figure 7:
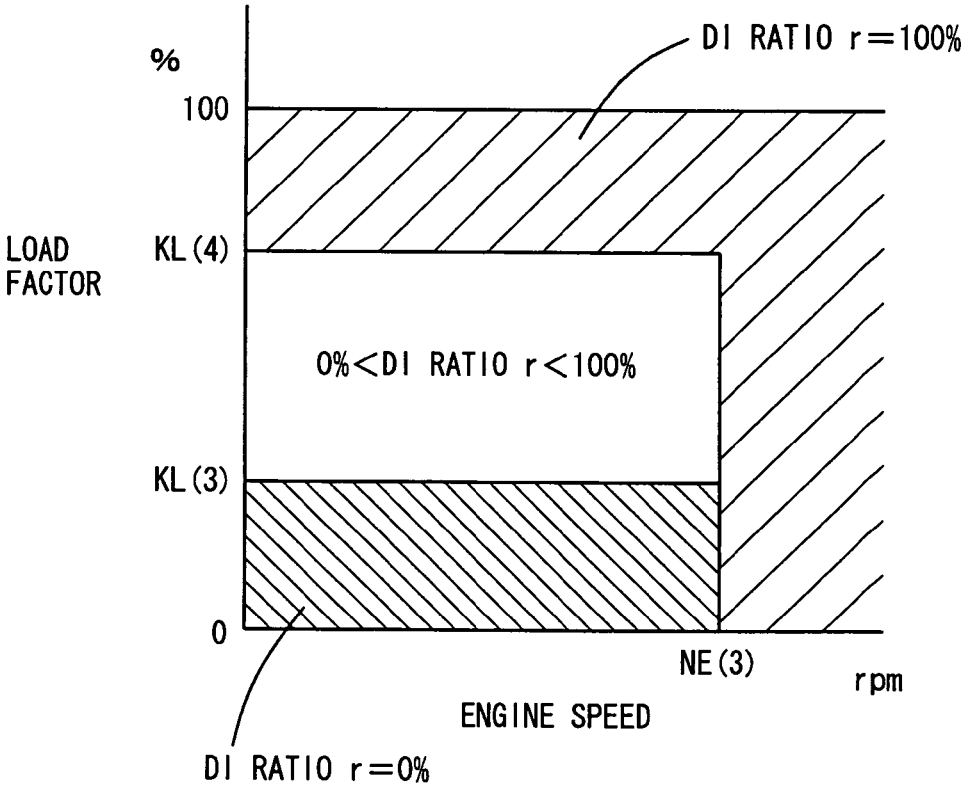
FIG. 7 represents a DI ratio map corresponding to a cold state of an engine to which the control apparatus of an engine of the present invention is suitably adapted (first DI ratio map).

Referring to FIGS. 6 and 7, maps indicating a fuel injection ratio (hereinafter, also referred to as DI ratio (r)) between in-cylinder injector 110 and intake manifold injector 120, identified as information associated with an operation state of engine 10, will now be described. The maps are stored in ROM 320 of engine ECU 300. FIG. 6 is the map for a warm state of engine 10, and FIG. 7 is the map for a cold state of engine 10.

In the maps of FIGS. 6 and 7, the fuel injection ratio of in-cylinder injector 110 is expressed in percentage as the DI ratio r, wherein the engine speed of engine 10 is plotted along the horizontal axis and the load factor is plotted along the vertical axis.

As shown in FIGS. 6 and 7, the DI ratio r is set for each operation region that is determined by the engine speed and the load factor of engine 10. "DI RATIO r=100%" represents the region where fuel injection is carried out from in-cylinder injector 110 alone, and "DI RATIO r=0%" represents the region where fuel injection is carried out from intake manifold injector 120 alone. "DI RATIO r≠0%", "DI RATIO r≠100%" and "0% <DI RATIO r<100%" each represent the region where in-cylinder injector 110 and intake manifold injector 120 partake in fuel injection. Generally, in-cylinder injector 110 contributes to an increase of power performance, whereas intake manifold injector 120 contributes to uniformity of the air-fuel mixture. These two types of injectors having different characteristics are appropriately selected depending on the engine speed and the load factor of engine 10, so that only homogeneous combustion is conducted in the normal operation state of engine 10 (for example, a catalyst warm-up state during idling is one example of an abnormal operation state).

Further, as shown in FIGS. 6 and 7, the DI ratio r of in-cylinder injector 110 and intake manifold injector 120 is defined individually in the maps for the warm state and the cold state of the engine. The maps are configured to indicate different control regions of in-cylinder injector 110 and intake manifold injector 120 as the temperature of engine 10 changes. When the temperature of engine 10 detected is equal to or higher than a predetermined temperature threshold value, the map for the warm state shown in FIG. 6 is selected; otherwise, the map for the cold state shown in FIG. 7 is selected. In-cylinder injector 110 and/or intake manifold injector 120 are controlled based on the engine speed and the load factor of engine 10 in accordance with the selected map.

The engine speed and the load factor of engine 10 set in FIGS. 6 and 7 will now be described. In FIG. 6, NE(1) is set to 2500 rpm to 2700 rpm, KL(1) is set to 30% to 50%, and KL(2) is set to 60% to 90%. In FIG. 7, NE(3) is set to 2900 rpm to 3100 rpm. That is, NE(1)<NE(3). NE(2) in FIG. 6 as well as KL(3) and KL(4) in FIG. 7 are also set appropriately.

In comparison between FIG. 6 and FIG. 7, NE(3) of the map for the cold state shown in FIG. 7 is greater than NE(1) of the map for the warm state shown in FIG. 6. This shows that, as the temperature of engine 10 becomes lower, the control region of intake manifold injector 120 is expanded to include the region of higher engine speed. That is, in the case where engine 10 is cold, deposits are unlikely to accumulate in the injection hole of in-cylinder injector 110 (even if fuel is not injected from in-cylinder injector 110). Thus, the region where fuel injection is to be carried out using intake manifold injector 120 can be expanded, whereby homogeneity is improved.

In comparison between FIG. 6 and FIG. 7, "DI RATIO r=100%" in the region where the engine speed of engine 10 is NE(1) or higher in the map for the warm state, and in the region where the engine speed is NE(3) or higher in the map for the cold state. In terms of load factor, "DI RATIO r=100%" in the region where the load factor is KL(2) or greater in the map for the warm state, and in the region where the load factor is KL(4) or greater in the map for the cold state. This means that in-cylinder injector 110 alone is used in the region of a predetermined high engine speed, and in the region of a predetermined high engine load. That is, in the high speed region or the high load region, even if fuel injection is carried out through in-cylinder injector 110 alone, the engine speed and the load of engine 10 are so high and the intake air quantity so sufficient that it is readily possible to obtain a homogeneous air-fuel mixture using only in-cylinder injector 110. In this manner, the fuel injected from in-cylinder injector 110 is atomized in the combustion chamber involving latent heat of vaporization (or, absorbing heat from the combustion chamber). Thus, the temperature of the air-fuel mixture is decreased at the compression end, so that the anti-knocking performance is improved. Further, since the temperature in the combustion chamber is decreased, intake efficiency is improved, leading to high power.

In the map for the warm state in FIG. 6, fuel injection is also carried out using in-cylinder injector 110 alone when the load factor is KL(1) or less. This shows that in-cylinder injector 110 alone is used in a predetermined low-load region when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, in which case accumulation of deposits is prevented. Further, clogging at in-cylinder injector 110 may be prevented while ensuring the minimum fuel injection quantity thereof Thus, in-cylinder injector 110 solely is used in the relevant region.

In comparison between FIG. 6 and FIG. 7, the region of "DI RATIO r=0%" is present only in the map for the cold state of FIG. 7. This shows that fuel injection is carried out through intake manifold injector 120 alone in a predetermined low-load region (KL(3) or less) when the temperature of engine 10 is low. When engine 10 is cold and low in load and the intake air quantity is small, the fuel is less susceptible to atomization. In such a region, it is difficult to ensure favorable combustion with the fuel injection from in-cylinder injector 110. Further, particularly in the low-load and low-speed region, high power using in-cylinder injector 110 is unnecessary. Accordingly, fuel injection is carried out through intake manifold injector 120 alone, without using in-cylinder injector 110, in the relevant region.

Further, in an operation other than the normal operation, or, in the catalyst warm-up state during idling of engine 10 (an abnormal operation state), in-cylinder injector 110 is controlled such that stratified charge combustion is effected. By causing the stratified charge combustion only during the catalyst warm-up operation, warming up of the catalyst is promoted to improve exhaust emission.

<Engine (2) to Which Present Control Apparatus is Suitably Adapted>

An engine (2) to which the control apparatus of the present embodiment is suitably adapted will be described hereinafter. In the following description of the engine (2), the configurations similar to those of the engine (1) will not be repeated.

Figure 8:
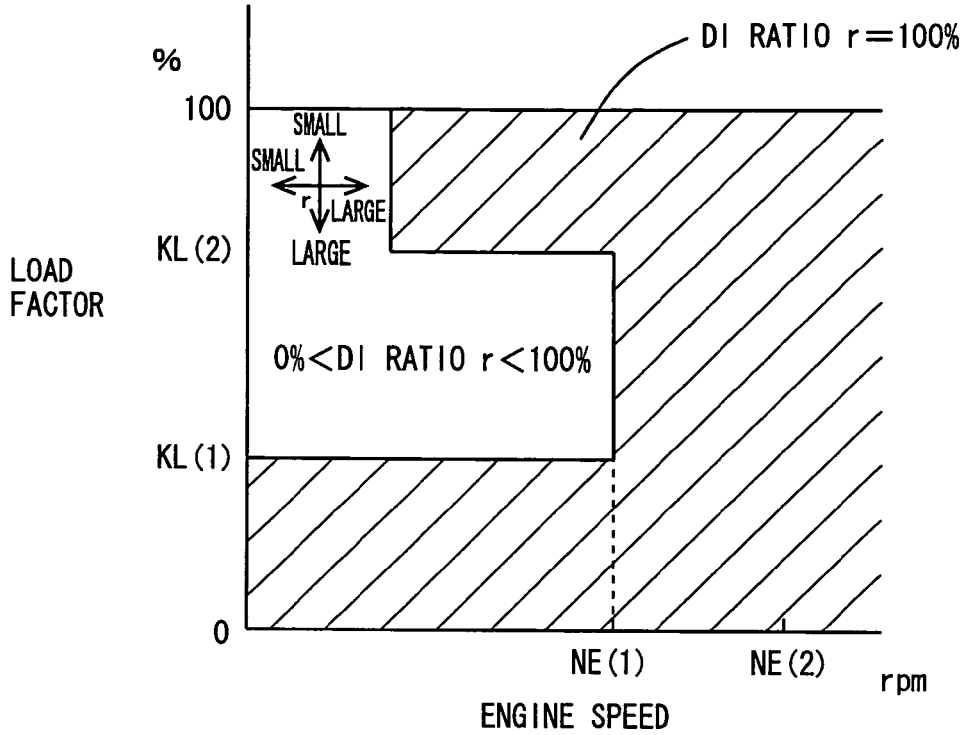
FIG. 8 represents a DI ratio map corresponding to a warm state of an engine to which the control apparatus of an embodiment of the present invention is suitably adapted (second DI ratio map).
Figure 9:
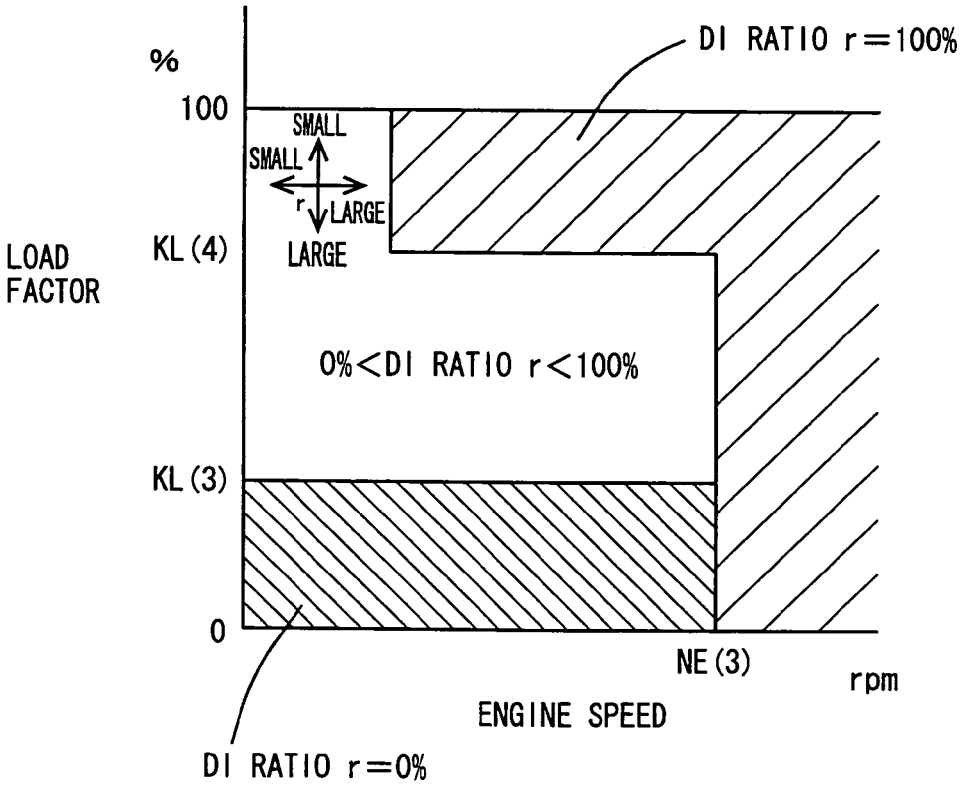
FIG. 9 represents a DI ratio map corresponding to a cold state of an engine to which the control apparatus of an embodiment of the present invention is suitably adapted (second DI ratio map).

Referring to FIGS. 8 and 9, maps indicating the fuel injection ratio between in-cylinder injector 110 and intake manifold injector 120, identified as information associated with the operation state of engine 10, will be described. The maps are stored in ROM 320 of an engine ECU 300. FIG. 8 is the map for the warm state of engine 10, and FIG. 6 is the map for the cold state of engine 10.

FIGS. 8 and 9 differ from FIGS. 6 and 7 in the following points. "DI RATIO r=100%" holds in the region where the engine speed of engine 10 is equal to or higher than NE(1) in the map for the warm state, and in the region where the engine speed is NE(3) or higher in the map for the cold state. Further, "DI RATIO r=100%" holds in the region, excluding the low-speed region, where the load factor is KL(2) or greater in the map for the warm state, and in the region, excluding the low-speed region, where the load factor is KL(4) or greater in the map for the cold state. This means that fuel injection is carried out through in-cylinder injector 110 alone in the region where the engine speed is at a predetermined high level, and that fuel injection is often carried out through in-cylinder injector 10 alone in the region where the engine load is at a predetermined high level. However, in the low-speed and high-load region, mixing of an air-fuel mixture produced by the fuel injected from in-cylinder injector 110 is poor, and such inhomogeneous air-fuel mixture within the combustion chamber may lead to unstable combustion. Thus, the fuel injection ratio of in-cylinder injector 110 is to be increased as the engine speed increases where such a problem is unlikely to occur, whereas the fuel injection ratio of in-cylinder injector 110 is to be decreased as the engine load increases where such a problem is likely to occur. These changes in the DI ratio r are shown by crisscross arrows in FIGS. 8 and 9. In this manner, variation in output torque of the engine attributable to the unstable combustion can be suppressed. It is noted that these measures are substantially equivalent to the measures to decrease the fuel injection ratio of in-cylinder injector 110 in connection with the state of the engine moving towards the predetermined low speed region, or to increase the fuel injection ratio of in-cylinder injector 110 in connection with the engine state moving towards the predetermined low load region. Further, in a region other than the region set forth above (indicated by the crisscross arrows in FIGS. 8 and 9) and where fuel injection is carried out using only in-cylinder injector 110 (on the high speed side and on the low load side), the air-fuel mixture can be readily set homogeneous even when the fuel injection is carried out using only in-cylinder injector 110. In this case, the fuel injected from in-cylinder injector 110 is atomized in the combustion chamber involving latent heat of vaporization (by absorbing heat from the combustion chamber). Accordingly, the temperature of the air-fuel mixture is decreased at the compression end, whereby the antiknock performance is improved. Further, with the decreased temperature of the combustion chamber, intake efficiency is improved, leading to high power output.

In engine 10 described in conjunction with FIGS. 6-9, homogeneous combustion is realized by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in totality is ignited in the combustion chamber to realize the stratified charge combustion. Even if the fuel injection timing of in-cylinder injector 110 is set in the intake stroke, stratified charge combustion can be realized if a rich air-fuel mixture can be located locally around the spark plug.

As used herein, the stratified charge combustion includes both the stratified charge combustion and semi-stratified charge combustion set forth below. In the semi-stratified charge combustion, intake manifold injector 120 injects fuel in the intake stroke to generate a lean and homogeneous air-fuel mixture in totality in the combustion chamber, and then in-cylinder injector 110 injects fuel in the compression stroke to generate a rich air-fuel mixture around the spark plug, so as to improve the combustion state. Such a semi-stratified charge combustion is preferable in the catalyst warm-up operation for the following reasons. In the catalyst warm-up operation, it is necessary to considerably retard the ignition timing and maintain a favorable combustion state (idling state) so as to cause a high-temperature combustion gas to arrive at the catalyst. Further, a certain quantity of fuel must be supplied. If the stratified charge combustion is employed to satisfy these requirements, the quantity of fuel will be insufficient. With the homogeneous combustion, the retarded amount for the purpose of maintaining favorable combustion is small as compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine described in conjunction with FIGS. 6-9, the fuel injection timing by in-cylinder injector 110 is preferably set in the compression stroke for the reason set forth below. It is to be noted that, for most of the fundamental region (here, the fundamental region refers to the region other than the region where semi-stratified charge combustion is carried out with fuel injection from intake manifold injector 120 in the intake stroke and fuel injection from in-cylinder injector 110 in the compression stroke, which is carried out only in the catalyst warm-up state), the fuel injection timing of in-cylinder injector 110 is set at the intake stroke. The fuel injection timing of in-cylinder injector 110, however, may be set temporarily in the compression stroke for the purpose of stabilizing combustion, as will be described hereinafter.

When the fuel injection timing of in-cylinder injector 110 is set in the compression stroke, the air-fuel mixture is cooled by the fuel injection during the period where the temperature in the cylinder is relatively high. This improves the cooling effect and, hence, the antiknock performance. Further, when the fuel injection timing of in-cylinder injector 110 is set in the compression stroke, the time required starting from fuel injection up to the ignition is short, so that the air current can be enhanced by the atomization, leading to an increase of the combustion rate. With the improvement of antiknock performance and the increase of combustion rate, variation in combustion can be obviated to allow improvement in combustion stability.

In an off-idle mode (when the idle switch is OFF, and the accelerator pedal is depressed), the warm map shown in FIG. 6 or 8 can be employed, regardless of the temperature of engine 10 (independent of a cold state or warm state). In other words, in-cylinder injector 110 is employed at a low load region regardless of whether in a cold state or warm state.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine including a first fuel injection mechanism injecting fuel into a cylinder and a second fuel injection mechanism injecting fuel into an intake manifold, said control apparatus comprising:

an injection control unit controlling said first and second fuel injection mechanisms such that said first and second fuel injection mechanisms partake in fuel injection based on a condition required of said internal combustion engine, a sensing unit provided at an exhaust system of said internal combustion engine for sensing an air-fuel ratio of exhaust, and a control unit for executing feedback control such that the air-fuel ratio attains a target air-fuel ratio based on said sensed air-fuel ratio, wherein said control unit executes feedback control by at least a proportional action only on a fuel injection quantity of said first fuel injection mechanism when said first fuel injection mechanism and said second fuel injection mechanism partake in fuel injection.

2. The control apparatus for an internal combustion engine according to claim 1, wherein said first fuel injection mechanism is an in-cylinder injector, and said second fuel injection mechanism is an intake manifold injector.

3. A control apparatus for an internal combustion engine including a first fuel injection mechanism injecting fuel into a cylinder and a second fuel injection mechanism injecting fuel into an intake manifold, said control apparatus comprising:

an injection control unit controlling said first and second fuel injection mechanisms such that said first and second fuel injection mechanisms partake in fuel injection based on a condition required of said internal combustion engine, a sensing unit provided at an exhaust system of said internal combustion engine for sensing an air-fuel ratio of exhaust, and a control unit for executing PID feedback control such that the air-fuel ratio attains a target air-fuel ratio based on said sensed air-fuel ratio, wherein said control unit executes feedback control such that a proportional action and a derivative action are reflected in a fuel injection quantity of said first fuel injection mechanism, and an integral action is reflected in the fuel injection quantity of said second fuel injection mechanism.

4. The control apparatus for an internal combustion engine according to claim 3, wherein said control unit executes feedback control by distributing a correction value corresponding to said integral action between the fuel injection quantity of said first fuel injection mechanism and the fuel injection quantity of said second fuel injection mechanism based on a fuel injection ratio corresponding to the partaking between said first fuel injection mechanism and said second fuel injection mechanism.

5. The control apparatus for an internal combustion engine according to claim 3, wherein said first fuel injection mechanism is an in-cylinder injector, and said second fuel injection mechanism is an intake manifold injector.

6. The control apparatus for an internal combustion engine according to claim 4, wherein said first fuel injection mechanism is an in-cylinder injector, and said second fuel injection mechanism is an intake manifold injector.

7. A control apparatus for an internal combustion engine including a first fuel injection mechanism injecting fuel into a cylinder and a second fuel injection mechanism injecting fuel into an intake manifold, said control apparatus comprising:

an injection control unit controlling said first and second fuel injection mechanisms such that said first and second fuel injection mechanisms partake in fuel injection based on a condition required of said internal combustion engine, a sensing unit provided at an exhaust system of said internal combustion engine for sensing an air-fuel ratio of exhaust, and a control unit for executing PI feedback control such that the air-fuel ratio attains a target air-fuel ratio based on said sensed air-fuel ratio, wherein said control unit executes feedback control such that a proportional action is reflected in a fuel injection quantity of said first fuel injection mechanism, and an integral action is reflected in the fuel injection quantity of said second fuel injection mechanism.

8. The control apparatus for an internal combustion engine according to claim 7, wherein said control unit executes feedback control by distributing a correction value corresponding to said integral action between the fuel injection quantity of said first fuel injection mechanism and the fuel injection quantity of said second fuel injection mechanism based on a fuel injection ratio corresponding to the partaking between said first fuel injection mechanism and said second fuel injection mechanism.

9. The control apparatus for an internal combustion engine according to claim 7, wherein said first fuel injection mechanism is an in-cylinder injector, and said second fuel injection mechanism is an intake manifold injector.

10. The control apparatus for an internal combustion engine according to claim 8, wherein said first fuel injection mechanism is an in-cylinder injector, and said second fuel injection mechanism is an intake manifold injector.

11. A control apparatus for an internal combustion engine including first fuel injection means for injecting fuel into a cylinder and second fuel injection means for injecting fuel into an intake manifold, said control apparatus comprising:

means for controlling said first and second fuel injection means such that said first and second fuel injection means partake in fuel injection based on a condition required of said internal combustion engine, means provided at an exhaust system of said internal combustion engine for sensing an air-fuel ratio of exhaust, and control means for executing feedback control such that the air-fuel ratio attains a target air-fuel ratio based on said sensed air-fuel ratio, wherein said control means comprises means for executing feedback control by at least a proportional action on only a fuel injection quantity of said first fuel injection means when said first fuel injection mechanism and said second fuel injection mechanism partake in fuel injection.

12. The control apparatus for an internal combustion engine according to claim 11, wherein said first fuel injection means is an in-cylinder injector, and said second fuel injection means is an intake manifold injector.

13. A control apparatus for an internal combustion engine including first fuel injection means for injecting fuel into a cylinder and second fuel injection means for injecting fuel into an intake manifold, said control apparatus comprising:

means for controlling said first and second fuel injection means such that said first and second fuel injection means partake in fuel injection based on a condition required of said internal combustion engine, means provided at an exhaust system of said internal combustion engine for sensing an air-fuel ratio of exhaust, and control means for executing PID feedback control such that the air-fuel ratio attains a target air-fuel ratio based on said sensed air-fuel ratio, wherein said control means comprises means for executing feedback control such that a proportional action and a derivative action are reflected in the fuel injection quantity of said first fuel injection means, and an integral action is reflected in the fuel injection quantity of said second fuel injection means.

14. The control apparatus for an internal combustion engine according to claim 13, wherein said control means comprises means for executing feedback control by distributing a correction value corresponding to said integral action between the fuel injection quantity of said first fuel injection means and the fuel injection quantity of said second fuel injection means based on a fuel injection ratio corresponding to the partaking between said first fuel injection means and said second fuel injection means.

15. The control apparatus for an internal combustion engine according to claim 13, wherein said first fuel injection means is an in-cylinder injector, and said second fuel injection means is an intake manifold injector.

16. The control apparatus for an internal combustion engine according to claim 14, wherein said first fuel injection means is an in-cylinder injector, and said second fuel injection means is an intake manifold injector.

17. A control apparatus for an internal combustion engine including first fuel injection means for injecting fuel into a cylinder and second fuel injection means for injecting fuel into an intake manifold, said control apparatus comprising:

means for controlling said first and second fuel injection means such that said first and second fuel injection means partake in fuel injection based on a condition required of said internal combustion engine, means provided at an exhaust system of said internal combustion engine for sensing an air-fuel ratio of exhaust, and control means for executing PI feedback control such that the air-fuel ratio attains a target air-fuel ratio based on said sensed air-fuel ratio, wherein said control means comprises means for executing feedback control such that a proportional action is reflected in the fuel injection quantity of said first fuel injection means, and an integral action is reflected in the fuel injection quantity of said second fuel injection means.

18. The control apparatus for an internal combustion engine according to claim 17, wherein said control means comprises means for executing feedback control by distributing a correction value corresponding to said integral action between the fuel injection quantity of said first fuel injection means and the fuel injection quantity of said second fuel injection means based on a fuel injection ratio corresponding to the partaking between said first fuel injection means and said second fuel injection means.

19. The control apparatus for an internal combustion engine according to claim 17, wherein said first fuel injection means is an in-cylinder injector, and said second fuel injection means is an intake manifold injector.

20. The control apparatus for an internal combustion engine according to claim 18, wherein said first fuel injection means is an in-cylinder injector, and said second fuel injection means is an intake manifold injector.

* * * * *